US008740638B2

(12) United States Patent
Lappoehn

(10) Patent No.: US 8,740,638 B2
(45) Date of Patent: Jun. 3, 2014

(54) DEVICE FOR RECEIVING A CABLE CONDUCTOR IN A CONTACTING MANNER

(75) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 9 days.

(21) Appl. No.: 13/518,430

(22) PCT Filed: Dec. 22, 2010

(86) PCT No.: PCT/DE2010/001505
§ 371 (c)(1),
(2), (4) Date: Aug. 22, 2012

(87) PCT Pub. No.: WO2011/076185
PCT Pub. Date: Jun. 30, 2011

(65) Prior Publication Data

US 2012/0322294 A1 Dec. 20, 2012

(30) Foreign Application Priority Data

Dec. 23, 2009 (DE) ..... 10 2009 060 521

(51) Int. Cl.
*H01R 4/26* (2006.01)

(52) U.S. Cl.
USPC ..... 439/397

(58) Field of Classification Search
USPC ..... 439/397, 402, 408–409, 395, 417
See application file for complete search history.

(56) References Cited

U.S. PATENT DOCUMENTS 3,611,264 A * 10/1971 Ellis, Jr. ..... 439/403
3,877,771 A * 4/1975 Jensen et al. ..... 29/752
4,192,570 A 3/1980 Van Horn
4,391,484 A 7/1983 Foederer (Continued)

FOREIGN PATENT DOCUMENTS

DE 101 49 815 5/2003
DE 20 2008 000 941 4/2008

(Continued)

OTHER PUBLICATIONS

International Search Report of PCT/DE2010/001505, Apr. 14, 2011.

(Continued)

*Primary Examiner* — Jean F Duverne
(74) *Attorney, Agent, or Firm* — Collard & Roe, P.C.

(57) ABSTRACT

The invention relates to a device for receiving at least one cable conductor (300) in a contacting manner, comprising at least two insulation displacement contacts (101, 102) arranged on a support and oriented to receive the at least one cable conductor and a hood element (200; 200') used to receive and guide the at least one cable conductor (300) and to contact the at least one cable conductor with the insulation displacement contacts (101, 102), first locking elements (111, 112) being arranged on the support (50), which first locking elements interact with second locking elements (233, 234) arranged on the hood element (200, 200') in such a way that the hood element (200; 200') can be connected to the support by the locking of the locking elements of the hood element (200; 200') with the first locking elements (101, 102) while electrical contacts of the at least one cable conductor (300) with the insulation displacement terminals (101, 102) are simultaneously established, is characterized in that the cable conductor (300) can be inserted and positioned directly in the hood element (200; 200').

10 Claims, 3 Drawing Sheets

(56) References Cited

U.S. PATENT DOCUMENTS

| | | | | |
|---|---|---|---|---|
| 5,549,484 | A | 8/1996 | Chen | |
| 5,551,889 | A | 9/1996 | Kozel et al. | |
| 6,050,845 | A | 4/2000 | Smalley, Jr. et al. | |
| 6,080,006 | A * | 6/2000 | Broder | 439/409 |
| 6,135,804 | A | 10/2000 | Lux | |
| 7,101,216 | B2 * | 9/2006 | Fasce et al. | 439/402 |
| 7,195,513 | B1 * | 3/2007 | Gherardini et al. | 439/401 |
| 7,335,049 | B2 * | 2/2008 | Alarcon et al. | 439/409 |
| 7,399,197 | B2 * | 7/2008 | Fasce et al. | 439/392 |
| 7,458,840 | B2 * | 12/2008 | Pratt | 439/409 |
| 2003/0171023 | A1 | 9/2003 | Turek et al. | |
| 2006/0189174 | A1 | 8/2006 | Fabian et al. | |
| 2007/0224887 | A1 | 9/2007 | Liao | |
| 2009/0023409 | A1 | 1/2009 | Kato et al. | |

FOREIGN PATENT DOCUMENTS

| | | |
|---|---|---|
| EP | 0 921 592 | 6/1999 |
| JP | 6-038160 | 2/1994 |
| JP | H06 38160 U | 5/1994 |

OTHER PUBLICATIONS

English translation of International Preliminary Report on Patentability and Written Opinion of the International Searching Authority of PCT/DE2010/001505.

German Search Report dated Oct. 29, 2010 in German Application No. 10 2009 060 521.5 with English translation of the relevant parts.

Examination Report dated Nov. 8, 2013 from European Patent Office in Application No. 10 812 843.0-1801 with English translation of relevant parts.

* cited by examiner

DEVICE FOR RECEIVING A CABLE CONDUCTOR IN A CONTACTING MANNER

CROSS REFERENCE TO RELATED APPLICATIONS

This application is the National Stage of PCT/DE2010/001505 filed on Dec. 22, 2010, which claims priority under 35 U.S.C. §119 of German Application No. 10 2009 060 521.5 filed on Dec. 23, 2009, the disclosure of which is incorporated by reference. The international application under PCT article 21(2) was not published in English.

The invention relates to an apparatus for receiving at least one cable conductor in a contacting manner with the features of the preamble of claim 1.

Such apparatuses are used for connecting and the electrical bonding of cable conductors, especially on printed circuit boards.

PRIOR ART

Such an apparatus is known for example from DE 20 2008 000 941 U1. A basic module is provided in this apparatus and a hood element which is also designated there as a conductor contact hood. Insulation-piercing contacts are provided in the basic module, which contacts are used for electrical bonding with cable conductors, which are respectively introduced into so-called conductor guide elements. The conductor guide elements are then positioned in the conductor contact hood. The conductor contact hood and the basic module comprise locking elements which enable a connection of conductor contact hood and basic module by locking. Electrical bonding with the cable conductors occurs by means of insulation-piercing contacts by locking the conductor contact hood with the basic module.

It is problematic in this apparatus that the cable conductors respectively need to be positioned in especially provided conductor guide elements, and said conductor guide elements thereafter need to be introduced into openings separately provided in the hood element. This mounting is laborious; it requires a large number of steps which are not easily conducive to automation.

Invention is therefore based on the object of further developing an apparatus of the kind mentioned above in such a way that the mounting and the electrical bonding of the cable conductors will be substantially simplified and automated mounting will also be enabled.

Advantages of the Invention

This object is achieved by an apparatus for receiving at least one cable conductor in a contacting manner with the features of claim 1.

The apparatus in accordance with the invention comes with the advantage that the cable conductor can be inserted and positioned directly in the hood element. The terms of directly inserted or positioned means that it is not necessary to use conductor guide elements or other elements for holding and positioning the cable conductor for example. Instead, the cable conductor will be arranged directly in the hood element and it is fixed by locking on the support with locking elements arranged on the support, with simultaneous electrical bonding of the cable conductor arranged in the hood element occurring by the insulation-piercing contacts.

The measures as mentioned in the dependent claims lead to advantageous further developments and improvements of the apparatus as stated in the independent claim.

A highly advantageous embodiment provides that the first locking elements arranged on the support are arranged on a common base plate substantially offset by an angle of 90° to the insulation-piercing contacts which are disposed in an aligned fashion successively behind one another. Stability will be substantially increased in this manner because the locking elements and the insulation-piercing contacts are integrally connected with one another. An especially preferred embodiment provides that the common base plate, the insulation-piercing contacts and the first locking elements are part of a single stamped part. This simplifies automated production of the insulation-piercing contacts and the locking elements. It is further advantageous that as a result of integral arrangement of base plate, insulation-piercing contacts and locking elements high stability of the entire arrangement and especially also of the locking elements is ensured. The locking elements consist in this case of a metal part, thereby substantially preventing likelihood of breakage as is otherwise certainly the case in the apparatus known from the state of the art where the locking elements respectively consist of plastic.

The base plate is preferably arranged on a printed circuit board by means of a soldered joint and is electrically bonded thereby. As a result, the insulation-piercing contacts and the locking elements are simultaneously fixed in one pass to the printed circuit board and at the same time an electrical contact of the insulation-piercing contacts with a strip conductor arranged on the printed circuit board or the like will be produced.

In summary, it can be confirmed that as a result of the arrangement of the locking elements which are arranged offset by 90° in relation to the insulation-piercing contacts and the integral arrangement of said locking elements, the insulation-piercing contacts and the base plate, and the fixing of the insulation-piercing contacts together with the locking elements by means of the base plate a synergetic effect is obtained with respect to high stability, excellent electric bonding and especially sturdiness of the locking elements.

The hood element preferably comprises two aligned openings for accommodating and guiding the at least one cable conductor, with the openings preferably being adjusted to the external shape of the cable conductor. As a result of the aligned arrangement, the cable conductor can already be arranged and guided in a respective position in the hood element. The hood element further comprises locking openings for the first locking elements.

A further relevant advantage of the apparatus in accordance with the invention is the planar arrangement of the hood element on its upper side, thereby forming a receiving region for accommodating a suction pipette used for automatic component placement. This enables an automatic positioning of the hood element via the insulation-piercing contacts and the locking elements.

A shape of the hood element which characterizes the alignment and which especially comprises a bevel marking a direction on three sides is used for rapid component placement. As a result, the hood element can rapidly be arranged in the correct position above the insulation-piercing contacts. Openings of various shapes and sizes which are also arranged on the upper side of the hood element are further used for easier positioning.

A highly advantageous embodiment provides that the hood element comprises a cable stop which protects a cable end, insulates the same and forms an end cover.

Preferably, said cable stop is integrally connected with the hood element.

The hood element preferably consists of plastic, thus providing electrical insulation.

BRIEF DESCRIPTION OF THE DRAWINGS

Embodiments of the invention are shown in the drawings and will be explained below in closer detail by reference to the following description, wherein.

EMBODIMENTS OF THE INVENTION

Figure 1A:
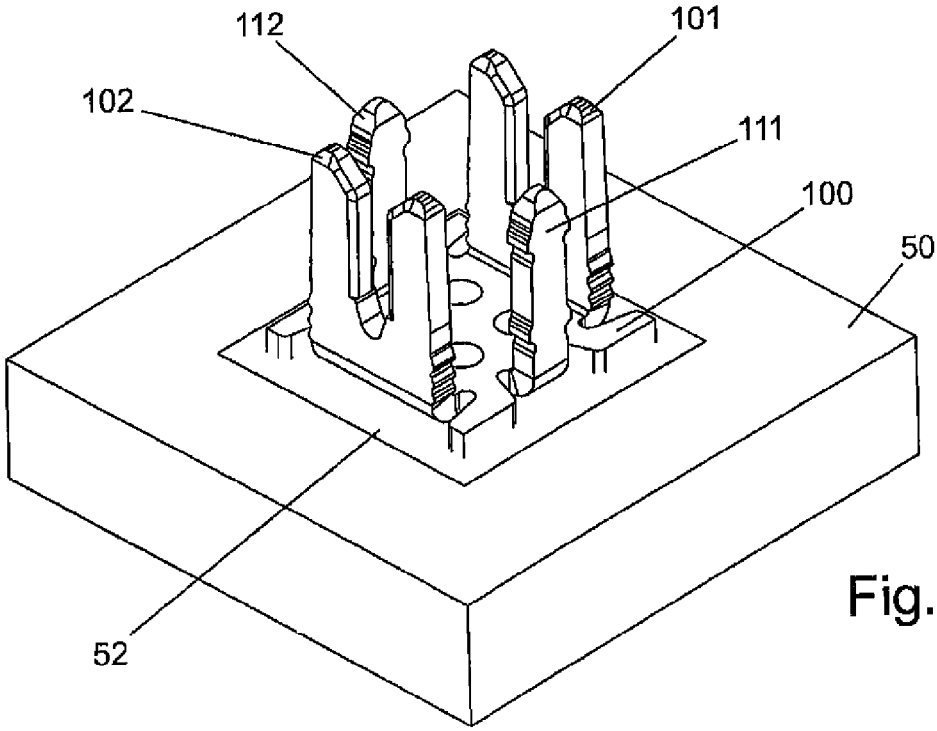
FIG. 1*a* shows an isometric view of insulation-piercing contacts and locking elements arranged on a printed circuit board of an apparatus in accordance with the invention for accommodating at least one cable conductor in a contacting manner.
Figure 1B:
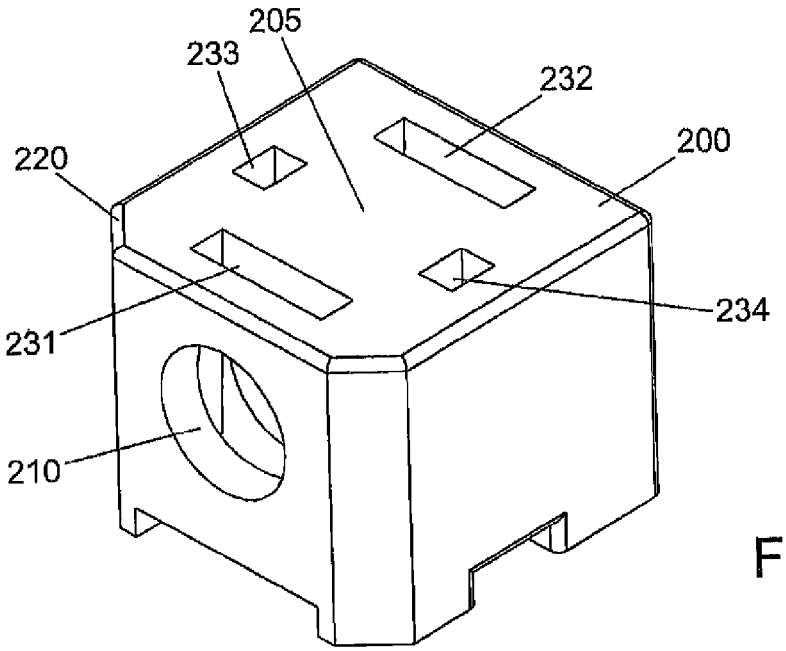
FIG. 1*b* shows an isometric view of a hood element of an apparatus in accordance with the invention for accommodating at least one cable conductor in a contacting manner.

An apparatus for receiving in a contacting manner at least one cable conductor which is shown in the dismounted state in FIG. 1*a* and FIG. 1*b* comprises two insulation-piercing contacts 101, 102 which are arranged on a support 50. First locking elements 111, 112 are respectively arranged offset by 90° in relation to the insulation-piercing contacts 101, 102. As is shown in FIG. 1*a*, the insulation-piercing contacts 101, 102 and the locking elements 111, 112 are part of a single stamped part together with a base plate 100. The base plate 100 is arranged on the support 50 by means of a soldered joint 52. The support 50 can be a printed circuit board for example. The arrangement of the insulation-piercing contacts 101, 102 and the first locking elements 111, 112 and the base plate 100 as a common stamped part allows simple and rapid production.

Moreover, the locking elements 111, 112 are substantially sturdier in form of metal parts than locking elements in form of plastic parts, as are known from the state of the art. These insulation-piercing contacts 101, 102 and locking elements 111, 112 are covered in the finally mounted state by a hood element 200, which is shown in FIG. 1*b*. Said hood element 200 comprises two aligned openings 210 for receiving a cable conductor, whereof the rear one is not shown in the isometric illustration of FIG. 1*b*. The hood element 200 further comprises a region 205 on its surface which is arranged in form of a flat surface and is used for receiving a suction pipette which is used in automatic component placement for example. The hood element 200 can therefore very advantageously also be used in automatic production. The hood element 200 comprises a bevel 220 on three sides which signalizes a direction of component placement. Furthermore, the hood element comprises openings 231, 232, 233, 234 on its upper side which have different shapes and arrangements. These openings are also used for rapid recognition of a component placement direction for example. The openings 233, 234 are further locking openings for the first locking elements 111, 112 and the openings 231, 232 correspond with the insulation-piercing contacts 101, 102 and are used for their stabilization.

Figure 2A:
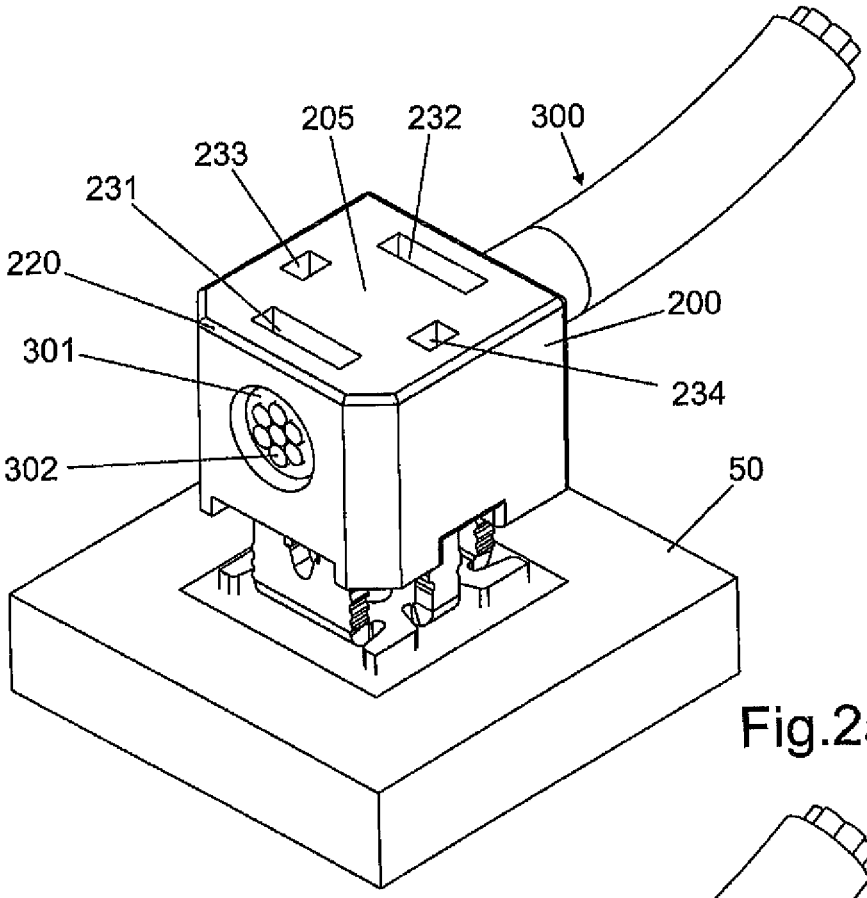
FIG. 2*a* schematically shows the mounting and electric bonding of a cable conductor by means of the apparatus in accordance with the invention.
Figure 2B:
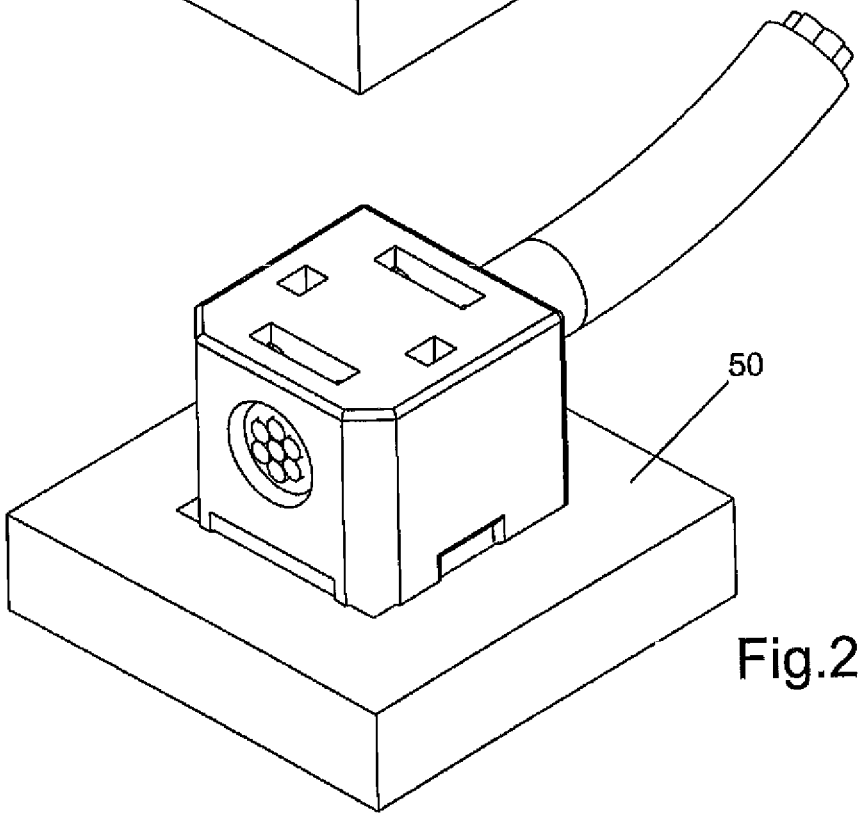
FIG. 2*b* shows the position of the mounted cable conductor.

FIG. 2*a* and FIG. 2*b* describe the sequence of fastening and electric bonding of a single conductor 300 by means of the apparatus in accordance with the invention. The single conductor 300 is guided at first through the aligned openings of the hood element 200, wherein notice must be taken that the opening 210 in the hood element is adjusted to the external shape of the single conductor 300 in such a way that the single conductor 300 lies with as little play as possible in the openings. As a result of this type of positioning of the single conductor 300 in the hood element 200, a guidance and precise positioning of the cable conductor 300 is achieved with respect to the insulation-piercing contacts 101, 102. The hood element 200 together with the cable conductor 300 arranged on said hood element is pressed in the direction of the locking elements 111, 112 by exerting a pressure directed substantially perpendicularly to the printed circuit board 50, by means of which they will latch into respective locking openings 233, 234 and simultaneously the electric bonding of the cable conductor 300 will be performed by means of the insulation-piercing contacts 101, 102 in such a way that the insulation-piercing contacts 101, 102 cut through an insulation jacket 301 and an electrical contact is produced between the strands 302 of the cable conductor and the insulation-piercing contacts 101, 102. FIG. 2*b* shows the readily mounted hood element on the printed circuit board 50. The conducting core of the cable conductor, i.e. the strands 302, is connected in an electrically conductive manner in this case with the insulation-piercing contacts 101, 102.

Figure 3:
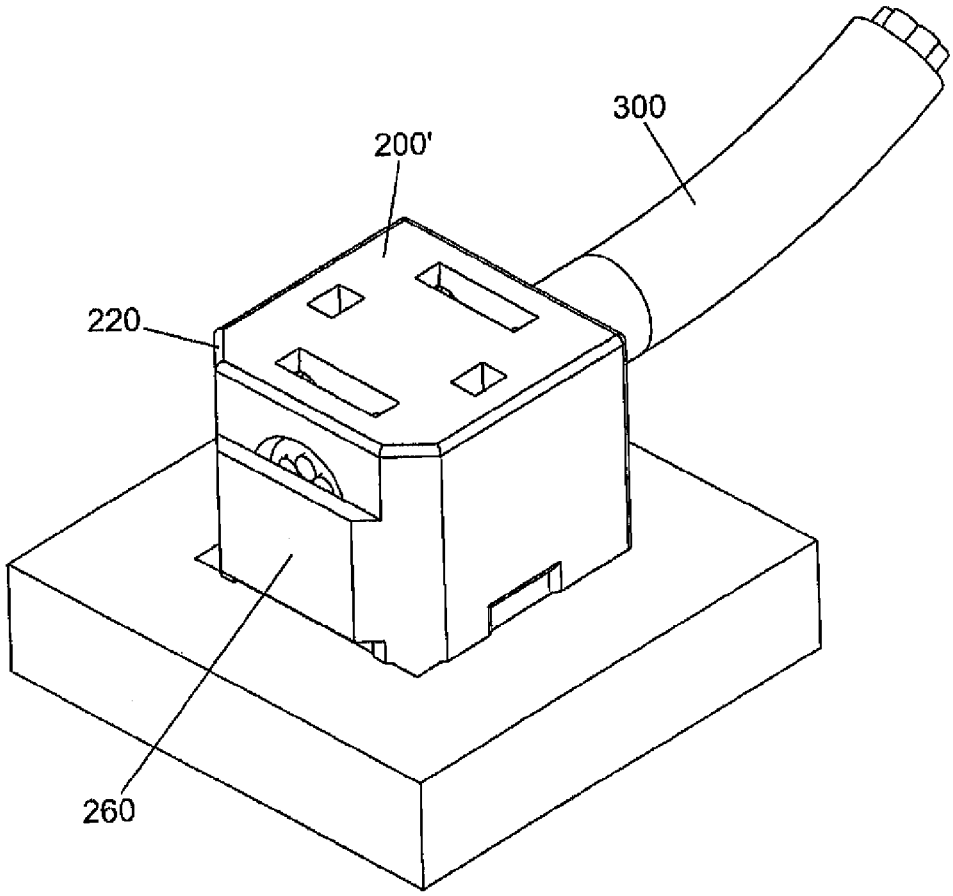
FIG. 3 schematically shows an isometric view of another embodiment of an apparatus in accordance with the invention in the finally mounted state.

FIG. 3 shows a further embodiment of an apparatus in accordance with the invention, in which the same elements are provided with the same reference numerals as in FIGS. 1 and 2. In contrast to the hood element as shown in FIGS. 1 and 2, the hood element 200' as shown in FIG. 3 comprises a cable stop 260 which protects the cable end of the cable conductor, insulates the same, forms an end cover and extends substantially transversely to the positioning direction which is indicated by the bevel. 220. The cable stop is preferably arranged in an integral fashion with the hood element 200' and consists of plastic like the hood element 200', thus providing insulation. The cable stop does not completely cover the front housing part of the hood element 200', but leaves a small opening which is substantially used for the purpose that the end of the cable conductor 300 and its arrangement in the opening 210 is visible. It is arranged in any case in such a way that a front insulation and a front protection of the cable conductor 300 are provided. It can also be provided that the cable stop 260 extends in a U-shaped manner over the front face side of the hood element 200' to such an extent that the cable conductor will protrude slightly from the opening and thereby ensure secure positioning and arrangement of the cable conductor 300 (not shown).

The invention claimed is:

1. An apparatus for receiving at least one cable conductor in a contacting manner, comprising at least two insulation-piercing contacts arranged on a support and oriented to receive the at least one cable conductor, and a hood element used to receive and guide the at least one cable conductor and to contact the at least one cable conductor with the insulation-piercing contacts, with first locking elements being arranged on the support, which first locking elements interact with second locking elements arranged on the hood element in such a way that the hood element can be connected to the support by locking the locking elements of the hood element with the first locking elements by simultaneously producing electrical contacts of the at least one cable conductor with the insulation-piercing contacts, wherein the cable conductor can be inserted and positioned directly in the hood element, and wherein the first locking elements arranged on the support are arranged on a common base plate substantially offset by an angle of 90° to the insulation-piercing contacts which are disposed one after the other in alignment.

2. An apparatus according to claim 1, wherein the common base plate, the insulation-piercing contacts and the first locking elements are part of a single stamped part.

3. An apparatus according to claim 1, wherein the base plate is arranged on a printed circuit board by means of a soldered joint.

4. An apparatus according to claim 1, wherein the hood element openings.

5. An apparatus according to claim 1, wherein the hood element is provided with a flat configuration on its upper side and comprises a receiving area for receiving a suction pipette used for automatic component placement.

6. An apparatus according to claim 1, wherein the hood element has a shape characterizing the alignment, especially a bevel on three sides marking the direction.

7. An apparatus according to claim 1, wherein a cable stop is provided on the hood element which protects the cable end, insulates the same and forms an end cover.

8. An apparatus according to claim 7, wherein the cable stop is integrally connected to the hood element.

9. An apparatus according to claim 1, wherein the hood element consists of plastic.

10. An apparatus for receiving at least one cable conductor in a contacting manner, comprising at least two insulation-piercing contacts arranged on a support and oriented to receive the at least one cable conductor, and a hood element used to receive and guide the at least one cable conductor and to contact the at least one cable conductor with the insulation-piercing contacts, with first locking elements being arranged on the support, which first locking elements interact with second locking elements arranged on the hood element in such a way that the hood element can be connected to the support by locking the locking elements of the hood element with the first locking elements by simultaneously producing electrical contacts of the at least one cable conductor with the insulation-piercing contacts, wherein the cable conductor can be inserted and positioned directly in the hood element, and wherein the hood element comprises two aligned openings for receiving and guiding the at least one cable conductor.

* * * * *

UNITED STATES PATENT AND TRADEMARK OFFICE

CERTIFICATE OF CORRECTION

PATENT NO. : 8,740,638 B2
APPLICATION NO. : 13/518430
DATED : June 3, 2014
INVENTOR(S) : Lappoehn It is certified that error appears in the above-identified patent and that said Letters Patent is hereby corrected as shown below:

In the Claims

In Column 5, line 10 (Claim 4), after the word "element" please insert the word:
--comprises--.

Signed and Sealed this
Twenty-third Day of September, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,740,638 B2
APPLICATION NO. : 13/518430
DATED : June 3, 2014
INVENTOR(S) : Lappoehn It is certified that error appears in the above-identified patent and that said Letters Patent is hereby corrected as shown below:

Claims

In Column 5, line 10 (Line 2 of Claim 4), before the word "openings" please insert the word: --locking--.

Signed and Sealed this
Nineteenth Day of January, 2016

Michelle K. Lee

Michelle K. Lee
*Director of the United States Patent and Trademark Office*